United States Patent [19]

Blewitt et al.

[11] 4,057,776

[45] Nov. 8, 1977

[54] FUSE WITH RADIALLY ORIENTED ELEMENTS

[75] Inventors: Donald D. Blewitt; Robert D. Binz, both of Pittsburgh, Pa.

[73] Assignee: Westinghouse Electric Corporation, Pittsburgh, Pa.

[21] Appl. No.: 653,042

[22] Filed: Jan. 28, 1976

[51] Int. Cl.[2] ..... H01H 85/08

[52] U.S. Cl. ..... 337/295; 337/159; 337/231

[58] Field of Search ..... 337/295, 290, 293, 159, 337/161, 291, 231, 234, 236; 336/200, 223, 206

[56] References Cited

U.S. PATENT DOCUMENTS

| | | | |
|---|---|---|---|
| 1,880,702 | 10/1932 | Birkenmaier | 337/234 |
| 1,897,342 | 2/1933 | Steinmayer | 337/291 |
| 3,134,874 | 5/1964 | Cameron | 337/295 |
| 3,153,713 | 10/1964 | Brandt, Jr. | 337/293 |
| 3,849,755 | 11/1974 | Blewitt et al. | 337/290 |

FOREIGN PATENT DOCUMENTS

| | | | |
|---|---|---|---|
| 214,512 | 4/1961 | Austria | 336/206 |
| 1,491,905 | 7/1967 | France | 336/200 |
| 1,253,353 | 11/1967 | Germany | 336/223 |

*Primary Examiner*—Harold Broome
*Attorney, Agent, or Firm*—M. J. Moran

[57] ABSTRACT

A high voltage current limiting fuse is taught which has a plurality of radially oriented, notched, pleated fuse ribbons. The fuse ribbons feed through radial slots in spacers at either end of the fuse barrel. A double fold in the fuse ribbon in the region of the slot in each case provides a locking terminal for abutting the fuse ribbon against the spacer. In addition, the double fold arrangement allows the fuse ribbon to be routed conveniently radially over the edge of the spacer and along the side of the fuse barrel, between the fuse barrel and the inside of a ferrule. This secures the end of the fuse element and provides electrical continuity between the fuse element and the ferrule.

5 Claims, 4 Drawing Figures

FUSE WITH RADIALLY ORIENTED ELEMENTS

BACKGROUND OF THE INVENTION

1. Field of the Invention

The subject matter of this invention relates generally to fuses and particularly to arrangements for terminating the ends of fuse ribbons.

2. Description of the Prior Art

High voltage current limiting fuses utilizing radially oriented elements or ribbons with current limiting notches and/or zig-zag (i.e. pleated) arrangements are known. Examples may be found in the following U.S. Pat. No. 2,866,040 issued Dec. 23, 1968 to W. F. Skeats; U.S. Pat. No. 3,134,874 issued May 26, 1964 to F. L. Cameron and assigned to the assignee of the present invention; U.S. Pat. No. 3,319,029 issued May 9, 1967 to P. C. Jacobs, Jr.; U.S. Pat. No. 2,773,151 issued Dec. 4, 1956 to E. W. Sugden; and U.S. Pat. No. 3,624,580 issued Nov. 30, 1971 to W. J. Elliott. Generally in all of the aforementioned patents the termination of the fuse element is made by soldering the element of similarly fastening it to a transverse spacer or support near the end of the fuse barrel. It would be convenient if radially the fuse element could be terminated by extending it over the edge of the support spacer and along the side of the fuse barrel to be compressed between the fuse barrel and one of the fuse ferrules. This is accomplished with circumferentially oriented fuse elements by a method known as magneforming. The magneforming process is described in U.S. Pat. No. 3,333,336 issued Aug. 1, 1967 to F. L. Cameron et al and assigned to the assignee of the present invention. Circumferentially oriented fuse elements are shown in the following U.S. Pat. No. 3,636,491 issued Jan. 18, 1972 to F. L. Cameron and assigned to the assignee of the present invention; U.S. Pat. No. 3,153,713 issued Oct. 20, 1964 to T. F. Brandt, Jr.; and U.S. Pat. No. 3,394,333 issued July 23, 1968 to P. C. Jacobs, Jr. Although the circumferential arrangement of fuse ribbons within a fuse is more easily adapted for termination by the magneforming or similar process, the circumferential arrangement of fuse elements is less desirable than the radial arrangement of fuse elements in some cases for a number of reasons; First, for a given number of fuse elements, element-to-element spacing within the fuse body is closer for a circumferential arrangement than for a radial arrangement. Close spacing increases the risk of fulgurite merging during the fuse interruption operation. Second, in the case of a cross-sectional analysis of circumferentially oriented fuse elements, it has been found that the arc energy of fusing is concentrated in a relatively narrow annulus. This causes a higher energy input into nearby arc quenching sand per unit volume of sand than is caused by utilizing the same number of radially oriented fuse elements because of the relatively wider annulus. Consequently the use of circumferentially oriented fuse elements rather than radially oriented fuse elements results in a lower interrupting capacity for the fuse. Finally, the radial configuration permits the heat generated during a fusing operation to have access to a greater volume of cooling sand per fuse element. This results in better arc cooling and subsequently permits improved arc extinction which is desirable. It would be advantageous to provide a fuse which had all of the previously described advantages of radially oriented fuse elements and the advantages associated with the circumferentially oriented fuse elements where convenient disposition of the end of the fuse element is made somewhere along the longitudinal body of the fuse barrel to facilitate termination by the magneforming process or a similar process.

SUMMARY OF THE INVENTION

In accordance with the present invention, a fuse is taught which utilizes longitudinally disposed but radially oriented fuse ribbons the ends of which feed through transverse spacers or plates at both ends of the fuse barrel. Each end of a fuse ribbon is folded three times so that it can be conveniently disposed along the outside of the fuse barrel to thus be secured there with a ferrule. The fuse elements may be notched for current limiting purposes and/or disposed in a zig-zag (i.e. pleated) configuration for providing a better thermal fatigue characteristic. The first two folds of the fuse elements provides a mass of fuse material which acts as a locking terminal and a local arcing terminal for the fuse element at the spacer.

BRIEF DESCRIPTION OF THE DRAWINGS

For a better understanding of the invention, reference may be had to the preferred embodiments shown in the accompanying drawings in which.

DESCRIPTION OF THE PREFERRED EMBODIMENT

Figure 1:
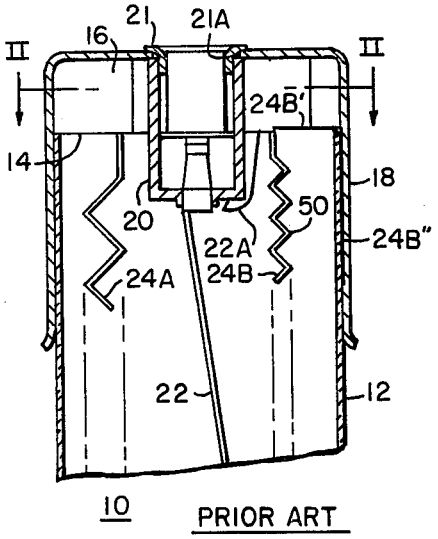
PRIOR ART FIG. 1
FIG. 1 shows a partial, sectional elevation of a prior art fuse which utilizes circumferentially oriented fuse elements.
Figure 2:
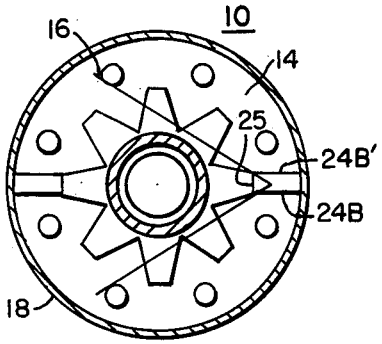
PRIOR ART FIG. 2
FIG. 2 shows a view of the fuse of FIG. 1 through the section II—II.

Referring now to the drawings and FIGS. 1 and 2 in particular, a prior art current limiting fuse 10 is shown. The prior art current limiting fuse 10 comprises a tubular casing or barrel 12 which is generally circular, hollow and cylindrical. An element spacer 14 is disposed adjacent the upper end of the barrel 12 as viewed in FIG. 1. A ferrule spacer 16 is disposed on top of the element spacer 14. In turn, a ferrule 18 is disposed adjacent the upper end of the tube casing 12. The ferrule 18 is separated or spaced from the element spacer 14 by the ferrule spacer 16. In this embodiment of the invention an indicator assembly 20 is disposed proximate the end of the ferrule 18 and the spacer 14. Connected to the indicator assembly 20 is an indicator wire 22 and an indicator wire loop 22A. A bushing 21 is disposed over the indicator assembly 20 in a central opening 21A of the ferrule 18. The indicator wire 22, the indicator assembly 20, the bushing 21 and the indicator wire loop 22A form no part of the present invention. In this embodiment of the invention, side views of two fuse ribbons or elements 24A and 24B are shown, it being noted that the pitch of the zig-zag or pleated arrangement of the fuse element 24A is relatively larger than the pitch of arrangement of the fuse element 24B. Using fuse element 24B as an example of a fuse termination arrangement, the following will be noted; Fuse element 24B which is essentially shown in a vertical position relative to FIG. 1 of the drawings, is folded over the edge of a slot 25 in the fuse element spacer 14. A portion 24B' of the fuse element 24B is shown traversing the distance between the edge of the slot 25 and the outer edge or circumference of the plate 14. At this point the fuse ribbon is folded again and is vertically oriented along the outside of fuse barrel 12, parallel to the orientation of that portion of the fuse element 24B which is within the fuse casing 12. The outside region of the fuse element 24B is generally designated 24B''. The region 24B'' of the fuse elements 24B is compressed between the outer surface of the fuse barrel 12 and the inner surface of the ferrule 18. A magneforming process may be utilized to locally constrict a portion of the ferrule 18 to thus compress portion 24B'' between the inner surface of the ferrule 18 and the outer surface of the barrel 12.

Figure 3:
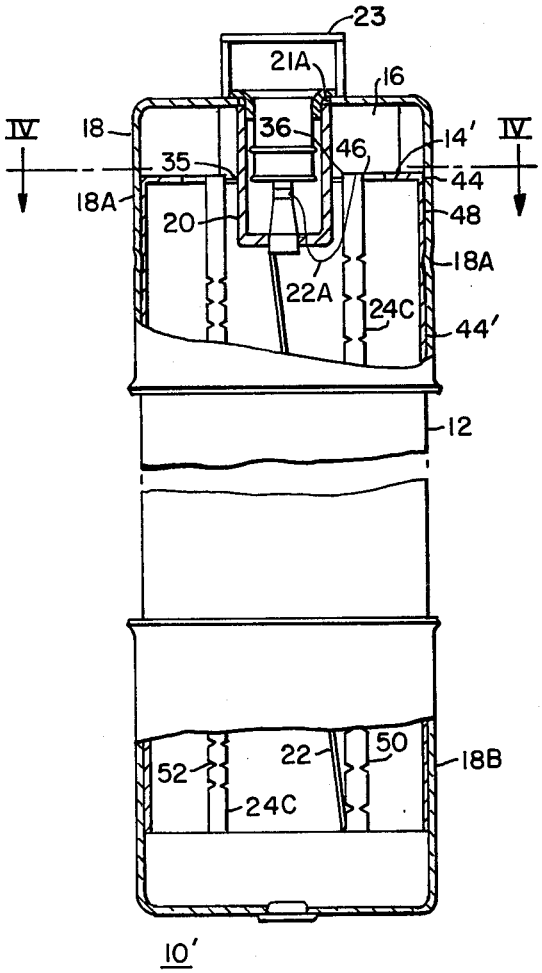
FIG. 3 shows an elevation of a fuse which is partially broken away and partially in section and which utilizes radially oriented fuse elements and a magneformed termination of fuse elements.
Figure 4:
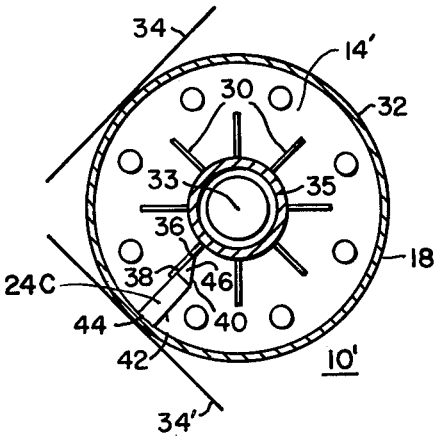
FIG. 4 shows a sectional view of the fuse of FIG. 3 through the section IV—IV.

Referring now to FIGS. 3 and 4 a preferred embodiment of the invention is shown. In this case there is a fuse assembly 10' which is similar to the fuse assembly 10 shown in FIGS. 1 and 2. As was the case with respect to the prior art fuse assembly 10 of FIGS. 1 and 2, there isprovided a hollow, cylindrical fuse barrel 12 which is preferably made of electrically insulating material such as glass melamine. Indicator assembly 20, fuse indicator wire 22, and loop 22A are also shown. A ferrule spacer 16 is disposed between an element spacer or plate 14' and a ferrule 18. In this embodiment of the invention, a cover 23 is provided for the indicator assembly 20, although it is to be understood that the presence of cover 23 is not limiting. There is disposed on the bottom of the barrel 12, a terminal 18B. In general, the interconnection of the fuse elements 24C with appropriate terminating apparatus on either end of the fuse barrel 12 is similar in this embodiment of the invention. Consequently, the description of fuse element interconnection and termination with respect to only the top portion of the fuse 10' (as viewed in FIG. 3) will be described. In this embodiment of the invention, the plate 14' is flat and circular. The radial dimension of circular plate 14' is measured from a central point 33. In addition, there is provided a central hole or opening 35 in the plate 14' through which the indicator assembly 20 may protrude. Radiating outwardly from the central opening 35 are a plurality of radial slots or openings 30 which are generally perpendicular to a tangent 34 of the edge portion 32 of the plate 14'. The flat ribbon-shaped edge portion of the fuse element 24C traverses the opening or slot 30 in the plate 14'. Fuse element 24C feeds through the slot 30 and is folded over an edge of the slot 30 at a first fold 36. The fuse element is then folded over once again at a second fold 40. That portion of the fuse element 24C between the first fold 36 and the second fold 40 is designated as a first end portion 38. End portion 38 lies flush against the upper surface of the plate 14'. A continuation of the fuse element from the fold 40 takes it generally out over the edge portion 32 of the plate 14' at a tangent 34' of the circumference of the plate 14'. The fuse element or ribbon 24C is here folded a third time against the edge portion 32 of the barrel 12 to form fold 44 and is then directed along the outside of the barrel 12 in a direction which is generally parallel to a line in that portion of the fuse element 24C which is within the barrel 12. The portion which runs along the outside of barrel 12 is designated as fuse portion 48. The broad surface of portion 48 is generally perpendicular to the broad surface of fuse element 24C within the barrel 12. The region between the second fold 40 and the third fold 44 is generally designated as a second portion 42. That part of portion 42 which overlaps portion 38 cooperates therewith to form a locking terminal 46 which generally keeps the fuse element 24C from significantly moving longitidinally within the fuse barrel 12. The third region 48 of fuse element 24C exists between the fold 44 and one end of fuse element 24C. Generally the plate 14' comprises electrically conductive material. The fuse element 24C may comprise periodic folds, pleats or zig-zag regions 50 and/or notches or regions of reduced cross-section 52. The ferrule 18 compresses portion 48 of fuse element 24C between the inner surface of the ferrule 18 and the outer surface of the barrel 12 at a region 18A which may circumscribe the ferrule 18. A magneforming indenture is provided in barrel 12 at region 18A for securing the ferrule 18 to the barrel 12 and for improving the electrical contact between the fuse element 24C and the ferrule 18.

It is to be understood with respect to the embodiments of the invention that the presence of the zig-zag regions 50 and the areas of reduced cross-section 52 are not necessarily limiting. It is also to be understood that the number of slots or openings 30 is not limiting. The spacing between slots or openings 30 need not be equal. It is also to be understood that the slots or openings 30 may vary angularly within limits from a radius emanating from the centerline 33. It is also to be understood that the fuse element 24C may be soldered or otherwise connected to the plate 14' such as at portions 38 or 42 or both. It is also to be understood that the arrangement of the termination of the fuse element 24C in the region 42 need not be perfectly perpendicular with the tangent 34' shown in FIG. 4 but may deviate therefrom within reasonalbe limits. It is also to be understood that the terminal 18B shown at the bottom of fuse 10' need not necessarily be the same type of terminal as terminal 18 shown at the top thereof. It is also to be understood that the number of fuse elements utilized is not limiting. It is also to be understood that the concepts of this invention may be used with other types of fuse besides high voltage current limiting fuses. It is also to be understood that in some embodiments of the invention, the fuse barrel 12, the plate 14' and the ferrules 18 need not necessarily have circular cross-sections. It should also be understood that the fuses described herein may be filled with pulverulent arc quenching material such as quartz sand for improved operation.

The apparatus taught with respect to the embodiments of this invention has many advantages. One advantage lies in the fact that the double folding of the fuse element 24C on the plate 14' provides a locking terminal 46 which is helpful in securing the fuse element 24C within the fuse barrel 12. Another advantage lies in the fact that the double folding technique shown best in FIG. 4 allows a radially oriented fuse element to be terminated along the outside of the fuse barrel 12 between the fuse barrel 12 and a ferrule 18 by utilizing a magneforming process or technique or the like for securing the termination. Another advantage lies in the fact that the locking terminal 46, since it comprises a double layer of fuse material provides a local arc terminal or point from which arcing may be sustained for a significant period of time in the fusing operation.

We claim as our invention:

1. A fuse, comprising:

a. electrically insulating, hollow, cylindrical fuse barrel means;

b. terminal means disposed adjacent one end of said barrel means;

c. flat, circular, plate means disposed transverse to the center line of said cylindrical barrel means adjacent to the other end of said barrel means, said plate means having a radial slot therein;

d. a fuse ribbon electrically connected to said terminal means and extending within said barrel means longitudinally thereof in a generally radial orientation, said fuse ribbon having an end portion thereof which feeds through said slot and folds over against one side of said plate means perpendicular to said slot, said ribbon being folded over again upon a portion of itself and said plate means in a parallel orientation to said slot, said end portion being also folded against the edge of said plate and along the outside of said barrel; and e. cylindrical ferrule means disposed securely against said barrel in electrical contact with said end portion.

2. The combination as claimed in claim 1 wherein said fuse ribbon is pleated within said fuse barrel.

3. The combination as claimed in claim 1 wherein said fuse ribbon has a region of reduced cross-section.

4. The combination as claimed in claim 1 wherein said ferrule is securely disposed against said fuse ribbon and said barrel at a constricted region of reduced circumference.

5. The combination as claimed in claim 1 wherein said folded-over portion of said fuse element acts as a locking terminal.

* * * * *